US005151737A

United States Patent [19]

Johnson et al.

[11] Patent Number: 5,151,737

[45] Date of Patent: Sep. 29, 1992

[54] PHOTOCONDUCTIVE DRUM HAVING EXPANDABLE MOUNT

[75] Inventors: Kevin M. Johnson; Michael S. Kowalczyk, both of Rochester, N.Y.

[73] Assignee: Eastman Kodak Company, Rochester, N.Y.

[21] Appl. No.: 533,215

[22] Filed: Jun. 4, 1990

[51] Int. Cl.[5] ..... G03G 15/00; G03G 21/00

[52] U.S. Cl. ..... 355/211; 29/117; 29/123

[58] Field of Search ..... 355/211, 212, 213; 29/117, 121.1, 123

[56] References Cited

U.S. PATENT DOCUMENTS

| | | | |
|---|---|---|---|
| 385,026 | 6/1888 | Waldron | 29/117 |
| 2,638,722 | 5/1953 | Rimmel | 29/117 X |
| 3,536,485 | 10/1970 | Roth et al. | 355/200 X |
| 3,695,757 | 10/1972 | Gregory | 355/211 X |
| 3,994,053 | 11/1976 | Hunt | 355/211 X |
| 4,120,576 | 10/1978 | Babish | 29/123 X |
| 4,161,357 | 7/1979 | Herman et al. | 355/211 X |
| 4,343,011 | 8/1982 | Murray et al. | 29/117 X |
| 4,527,883 | 7/1985 | Kamiyama | 355/211 |
| 4,766,455 | 8/1988 | Carter | 355/212 |
| 4,823,160 | 4/1989 | Ikuta et al. | 355/211 |

*Primary Examiner*—Fred L. Braun

*Attorney, Agent, or Firm*—Leonard W. Treash, Jr.

[57] ABSTRACT

A photoconductive drum has a flexible photoconductive loop and an expandable mount. The mount includes a shell with a slit allowing the shell to expand. A pair of wedges are moved toward each other on a shaft. Cam surfaces on the wedges push against chamfered corners on ribs extending inward from the shell to expand both ends of the shell. The shell assumes the shape of the loop even though loop is slightly conical.

9 Claims, 3 Drawing Sheets

PHOTOCONDUCTIVE DRUM HAVING EXPANDABLE MOUNT

TECHNICAL FIELD

This invention relates to electrophotography and more specifically to a photoconductive drum of the type including a photoconductive loop mounted on an expandable mount.

BACKGROUND ART

U.S. Pat. No. 3,536,485, Roth et al is illustrative of a number of references which show a photoconductive drum in which the photoconductive surface is part of a flexible web. The web is first formed into an endless loop. The loop is mounted on a mandrel which has a natural size larger than the interior of the loop but which is contracted for purposes of mounting. The mandrel is allowed to expand to hold the loop and form a photoconductive drum.

Drums formed in this manner are less expensive than the traditional photoconductive drum in which the photoconductive layers are coated on the exterior of a continuous cylinder. The loops can be formed by traditional web coating and finishing operations in which extremely high quality is obtainable at low cost. When the photoconductive surface has worn out, the loop is replaced. This has an obvious advantage over reconditioning a coated drum which requires grinding and/or solvent treating the sensitive surface, finishing and recoating.

Photoconductive loops are cut from a larger web. They include a suitable support, for example, polyester, with the necessary electrophotographic layers coated thereon, for example, a conductive layer and one or more photoconductive and other layers that make up a modern photoconductive plate or web. After cutting to the desired size the loops are formed by connecting two opposite ends together at a seam, which may be ultrasonically formed. The seaming process itself is extremely well developed. However, at present, it is not possible to consistently eliminate meaningful amounts of conicalness from the final loop. That is, in general, the circumference of the loop at one end will be slightly different from the circumference at the other end. The loop, rather than being a perfect cylinder is slightly conical in shape.

Some conicalness in the final drum can be absorbed in the system by mounting components against the drum. That is, if the left side of a development station is maintained the same distance from the drum that the right side of the development station is maintained, the conicalness in the drum itself will not show up as an image defect in the final print or copy. However, if the mandrel for a loop is a perfect cylinder, and the loop itself is conical there will necessarily be some looseness of the loop at the larger circumference end. Such looseness permits dirt to get under the loop, which can cause image defects of a far more serious nature than conicalness of the drum itself. The looser edge acts differently to hard and soft backed stations than does the tight edge. In color systems, image registration can vary between the loose and tight edge.

DISCLOSURE OF THE INVENTION

It is an object of the invention to provide a photoconductive drum generally of the type including an expandable mount supporting a photoconductive loop in which the tendency toward looseness of the loop at one of the opposing ends is lessened or eliminated.

This and other objects are accomplished by an expandable mount for the loop which mount includes a generally cylindrically-shaped shell having opposed open ends and an axial slit permitting expansion of the shell. A pair of wedges are positioned inside the shell, which wedges are movable toward or away from each other. Cam surfaces associated with the shell and the wedges convert force applied changing the distance between the wedges to a pair of forces expanding opposite ends of the shell.

With such structure comparable forces expanding the shell at essentially each end of the shell will cause the shell to generally assume the shape of the loop. Since any loop has some stretch to it, a portion of the conicalness will be removed by the mandrel causing somewhat more stretch to the smaller circumference end of the loop. The rest of the conicalness will be conformed to by the mandrel leaving no looseness at the larger end of the resulting photoconductive drum.

According to a preferred embodiment the shell is formed of a single casting which includes a cylindrically shaped outer surface and ribs projecting from the inside of the shell toward its center. The ribs have chamfered edges which form shell cam surfaces. A pair of cylindrical wedges are mounted on a shaft. The wedges have cam surfaces which mate with the chamfered surfaces. The shaft has clamp threads upon which a suitable clamp nut can be turned to move the wedges closer together. As the nut is tightened the wedges move closer together and the cam surfaces expand opposite ends of the shell with generally equal forces. These forces are resisted by the loop causing the shell to generally assume the shape of the loop, with some stretching.

BRIEF DESCRIPTION OF THE DRAWINGS

In the detailed description of the preferred embodiment of the invention presented below, reference is made to the accompanying drawings, in which.

DISCLOSURE OF THE PREFERRED EMBODIMENTS

Figure 1:
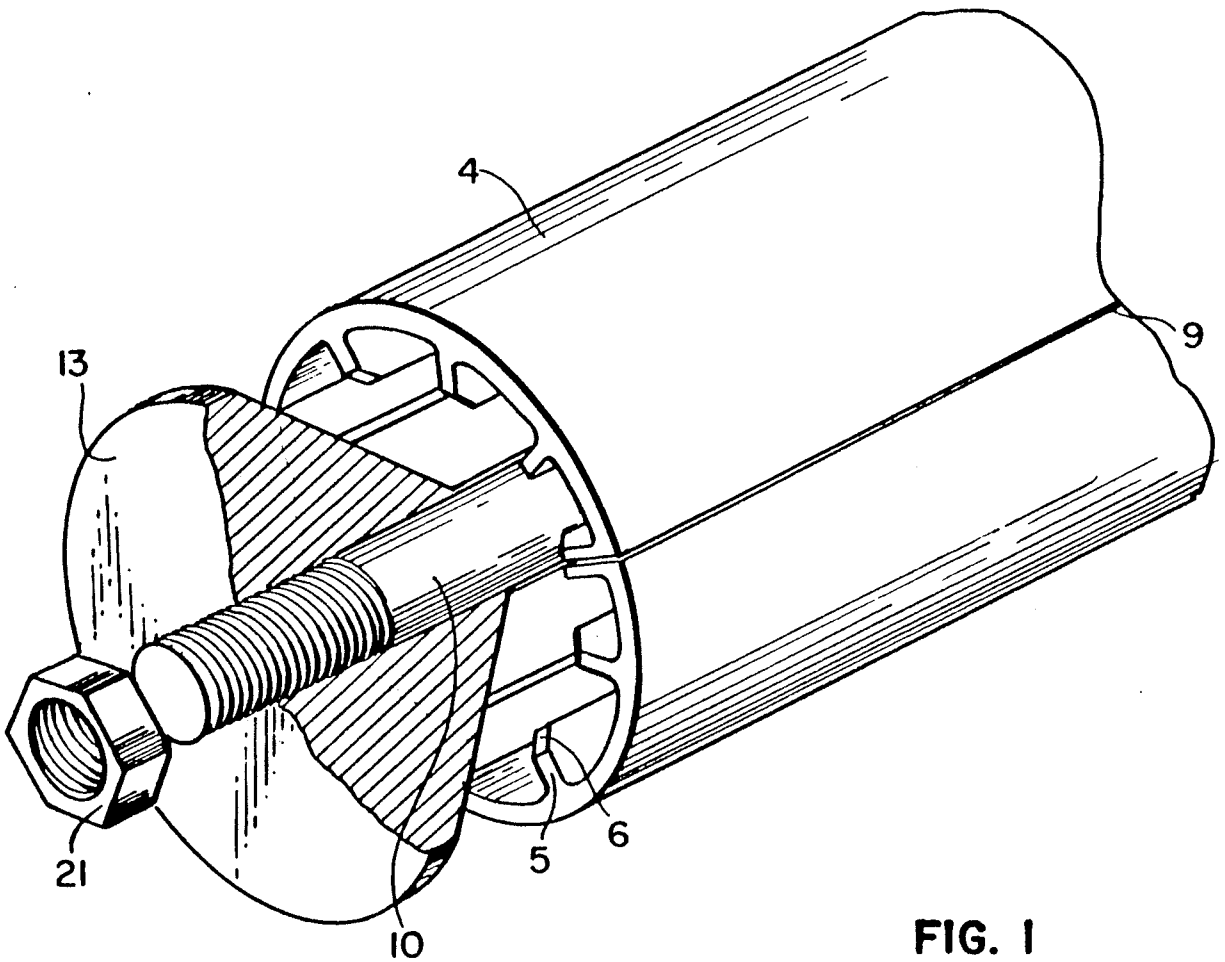
FIG. 1 is an exploded perspective view of a mount constructed according to the invention.
Figure 2:
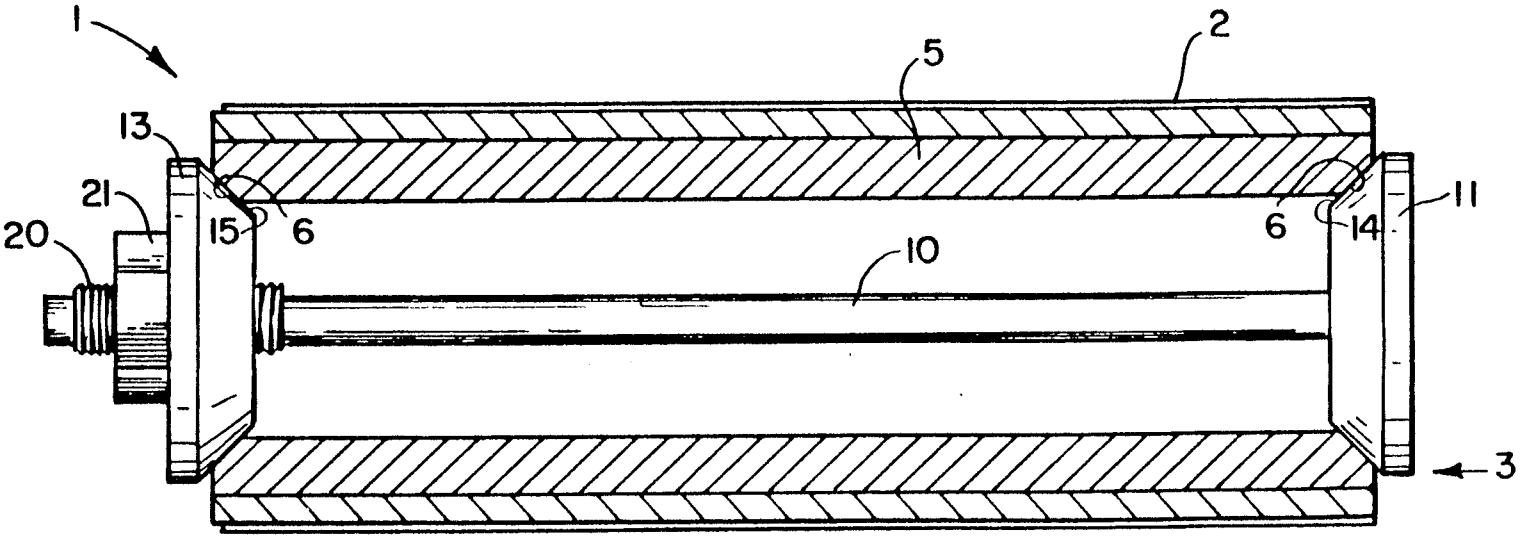
FIGS. 2 and 3 are cross-sections of a photoconductive drum constructed according to alternative embodiments of the invention.

According to FIG. 2 a photoconductive drum 1 includes a photoconductive loop 2 and an expandable mount 3 therefor. The mount 3 includes a shell 4, shown best in FIG. 1. The shell 4 is cast out of aluminum or other suitable material as a complete cylinder. After casting, a slit 9 is cut axially to permit the shell to be expanded. In its unstressed condition, it is enough smaller than the inside of loop 2 that loop 2 may be fit over it. Cast to the inside of shell 4 are ribs 5 which have chamfered corners 6 at each end.

A shaft 10 runs the length of the shell and includes a fixed wedge 11 at one end. Wedge 11 can be machined integrally with shaft 10 or it can be held on shaft 10 by a pair of nuts or the like. It is shown in FIG. 2 formed integrally with shaft 10. A second wedge 13 of substantially the same shape as wedge 11 is positioned on shaft 10 and is movable axially thereon. The left end of shaft 10 as seen in FIG. 2 has a sleeve 20 with clamp threads on which second wedge 13 is mounted. A clamp nut 21 has interior threads mating with the clamp threads on sleeve 20.

In assembly, shell 4 in its contracted and relaxed condition receives loop 2 as shown in FIG. 2. Shaft 10 with wedge 11 fixed thereon is inserted from the right end of shell 4. Wedge 13 and nut 21 are positioned on the left end of shaft 10.

Wedges 11 and 13 have cam surfaces 14 and 15 respectively which mate with the chamfered corners 6 of ribs 5. Ideally, each of these surfaces are at 45 degree angles so that any reduction in the distance between wedges 11 and 13 will increase the forces on the ribs forcing the shell to expand.

As nut 21 is tightened, the wedges 11 and 13 move closer together applying substantially equal forces on chamfered corners 6 forcing the end portions of the shell to expand with substantially equal force. As the loop begins to restrict the expansion of the shell, its smallest circumference end both tends to stretch slightly and also tends to resist the movement of wedge associated with that end thereby causing the other end of shell 4 to expand more than the end of the shell at the narrower end of the loop. The shell thus tends to take the conical shape of the loop as stretched. The final product is a photoconductive drum that has somewhat less conicalness than the unstretched loop but also has a shell which is slightly conical to match it. The slit 9, of course, is slightly different width at one end than the other.

The chamfered ribs 5 are shown as a preferred embodiment. With well machined parts, the wedges could actually rest against the outside edges of the inner wall of the shell, the direction of the expanding force coming entirely from the shape of the wedges. Similarly the wedges could lack the slanted surfaces 14 and 15 relying totally on the slanted surfaces 6 for the change in direction of the force from nut 21. The surfaces 6, 14 and 15 are shown at generally 45 degrees to the axis. Obviously, these surfaces could be at other inclines depending on the mechanical advantage desired from their contact. Note that substantial mechanical advantage is added to this system by the pitch of the threads of nut 21.

Figure 3:
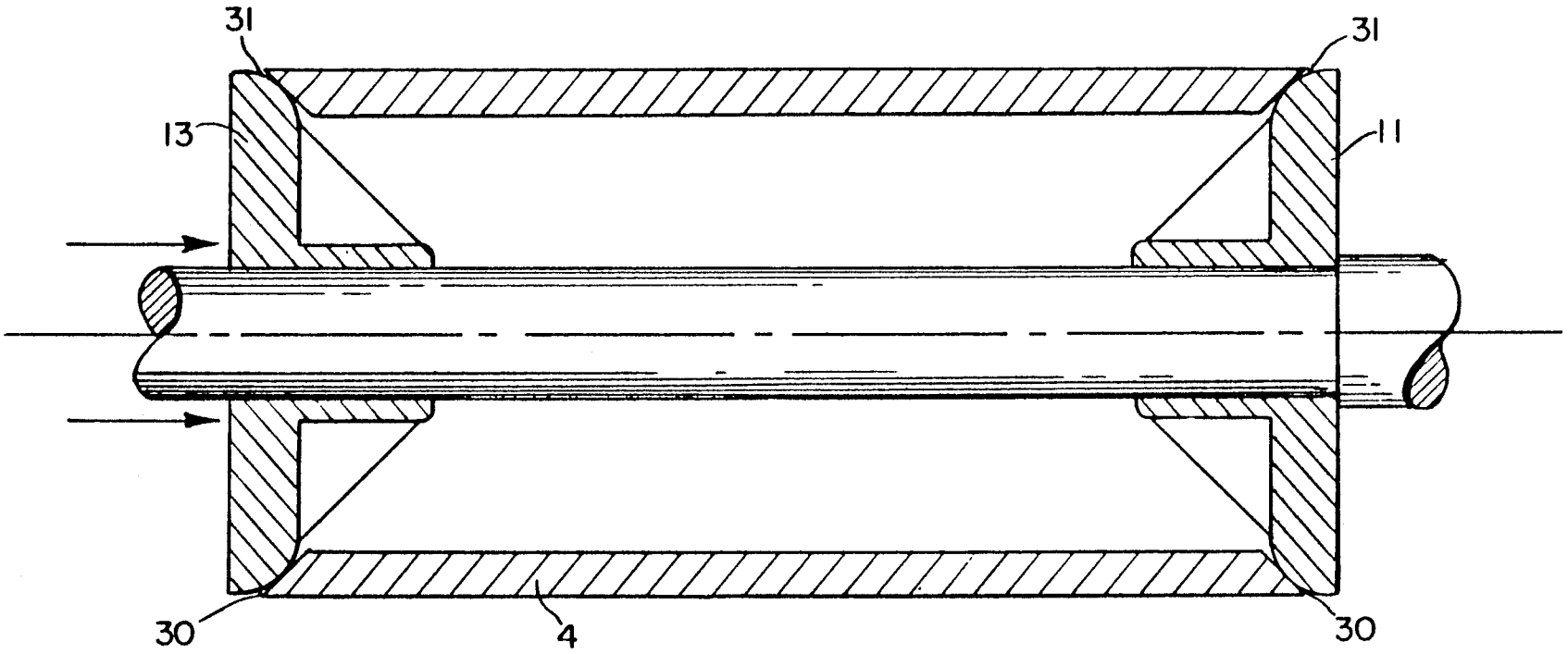

FIG. 3 shows an embodiment in which the shell 4 has inclined surfaces 30 which respond to curved surfaces 31 on wedges 11 and 13.

The invention has been described in detail with particular reference to a preferred embodiment thereof, but it will be understood that variations and modifications can be effected within the spirit and scope of the invention as described hereinabove and as defined in the appended claims.

We claim:

1. A photoconductive drum comprising:

a flexible photoconductive loop which may have opposite ends which differ in internal circumference, an expandable mount for said loop, said mount including a generally cylindrical-shaped shell having an axis of rotation, opposing open ends and a slit between the ends, said slit permitting expansion of said shell, a pair of wedges mounted radially closer to said axis than said shell, means for exerting a force on said wedges tending to change the axial distance between said wedges, said wedges and said shell having cooperative cam surfaces which convert said force to a cooperative pair of forces sufficient to expand opposite ends of said shell to conform separately the ends of the shell to any conicity of the loop caused by a difference in internal circumference of the opposite ends of the loop.

2. A drum according to claim 1 wherein said wedges are connected by a shaft and said means for changing the distance between the wedges includes means for moving one of said wedges along said shaft.

3. A drum according to claim 1 wherein said cam surfaces include at least one wedge cam surface defined by each wedge which cam surface inclines toward the axis as said surface extends toward the opposite wedge, and each of said pair of forces expanding said shell is increased as the distance between said wedges is decreased.

4. A drum according to claim 2 wherein said cam surfaces include at least one wedge cam surface defined by each wedge which cam surface inclines toward the axis as said surface extends toward the opposite wedge, and each of said pair of forces expanding said shell is increased as the distance between said wedges is decreased.

5. A drum according to claim 1 wherein said cam surfaces include at least two shell cam surfaces defined by said shell, at least one of said shell cam surfaces inclining toward said axis as it extends away from one end of said shell and at least one of said shell cam surfaces inclining toward said axis as it extends away from the other end of said shell, and each of said pair of forces expanding said shell is increased as the distance between said wedges is decreased.

6. A drum according to claim 3 wherein said cam surfaces include at least two shell cam surfaces defined by said shell, at least one of said shell cam surfaces inclining toward said axis as it extends away from each end of said shell and being inclined in the same direction as one of said wedge cam surfaces and being in contact therewith for converting said force reducing the distance between said wedges to said one of said pair of forces tending to expand said ends of said shell.

7. A drum according to claim 4 wherein said cam surfaces include at least two shell cam surfaces defined by said shell, at least one of said shell cam surfaces inclining toward said axis as it extends away from each end of said shell and being inclined in the same direction as one of said wedge cam surfaces and being in contact therewith for converting said force reducing the distance between said wedges to said one of said pair of forces tending to expand said ends of said shell.

8. A drum according to claim 6 wherein said shell cam surfaces are a plurality of cam surfaces defined as chamfers on ribs extending toward the axis from the inside of said shell.

9. A drum according to claim 7 wherein said shell cam surfaces are a plurality of cam surfaces defined as chamfers on ribs extending toward the axis from the inside of said shell.

* * * * *